US009588458B2

(12) United States Patent
Makita

(10) Patent No.: US 9,588,458 B2
(45) Date of Patent: Mar. 7, 2017

(54) DEVELOPING DEVICE AND IMAGE FORMING APPARATUS

(71) Applicant: FUJI XEROX CO., LTD., Tokyo (JP)

(72) Inventor: Shota Makita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/001,515

(22) Filed: Jan. 20, 2016

(65) Prior Publication Data

US 2017/0038704 A1 Feb. 9, 2017

(30) Foreign Application Priority Data

Aug. 6, 2015 (JP) ..... 2015-155871

(51) Int. Cl.
*G03G 15/08* (2006.01)

(52) U.S. Cl.
CPC ..... *G03G 15/0812* (2013.01)

(58) Field of Classification Search
None
See application file for complete search history.

(56) References Cited

U.S. PATENT DOCUMENTS 6,144,820 A * 11/2000 Ishii ..... G03G 15/0898 399/103
2006/0291928 A1* 12/2006 Lee ..... G03G 21/0029 399/350

FOREIGN PATENT DOCUMENTS

JP 2000-275965 A 10/2000

* cited by examiner

*Primary Examiner* — Clayton E LaBalle
*Assistant Examiner* — Victor Verbitsky
(74) *Attorney, Agent, or Firm* — Oliff PLC

(57) ABSTRACT

A developing device includes a developer holding body, a container, a contact member, and a restriction member. The developer holding body supplies a developer to an image holding body. The container accommodates the developer holding body and is formed with an opening portion facing the image holding body. The deformable contact member is fixed in the container and on a downstream side of the opening portion body in a rotation direction of the developer holding body and includes a tip end which extends toward an inner side of the container and which contacts with the developer holding body. The restriction member is disposed on an image holding body side of the contact member and restricts the tip end of the contact member from deforming so as to be in a state where the contact member is directed toward an outer side of the container.

13 Claims, 5 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2015-155871 filed Aug. 6, 2015.

BACKGROUND

Technical Field

The invention relates to a developing device and an image forming apparatus.

SUMMARY

According to an aspect of the invention, a developing device includes a cylindrical developer holding body, a container, a deformable contact member, and a restriction member. The developer holding body supplies a developer to an image holding body on which an electrostatic latent image is formed, while holding the developer and rotating. The container accommodates the developer holding body and is formed with an opening portion facing the image holding body. The deformable contact member is fixed in the container and on a downstream side of the opening portion body in a rotation direction of the developer holding body and includes a tip end which extends toward an inner side of the container and which contacts with the developer holding body. The restriction member is disposed on an image holding body side of the contact member and restricts the tip end of the contact member from deforming so as to be in a state where the contact member is directed toward an outer side of the container.

BRIEF DESCRIPTION OF THE DRAWINGS

Exemplary embodiments of the present invention will be described in detail based on the following figures, wherein.

DETAILED DESCRIPTION

1. Exemplary Embodiment

1-1. Overall Configuration of Image Forming Apparatus

Figure 1:
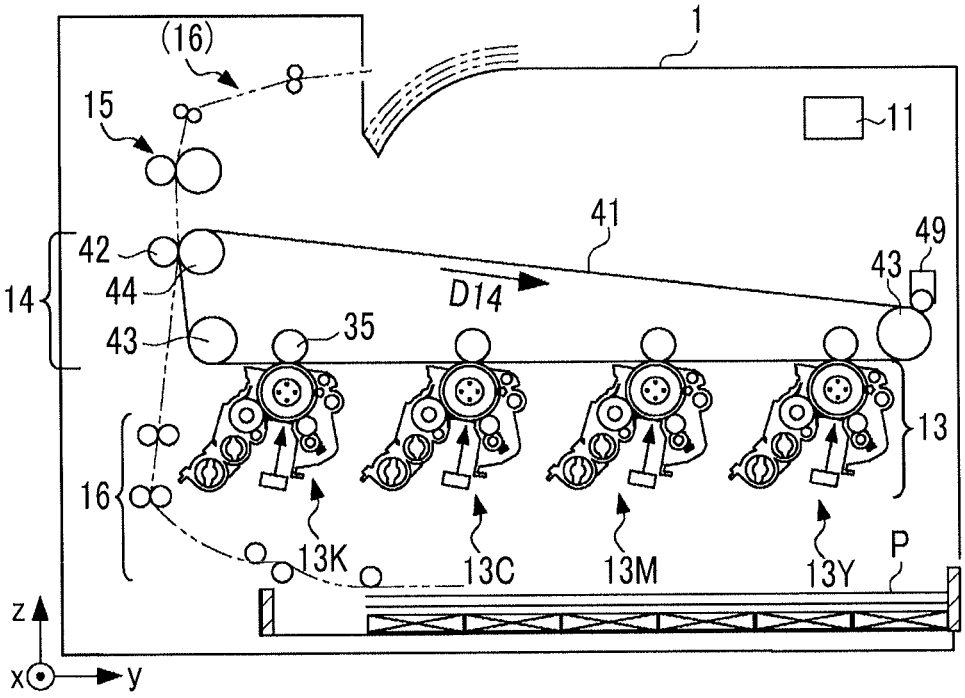
FIG. 1 is a diagram illustrating the overall configuration of an image forming apparatus according to an exemplary embodiment of the invention.

FIG. 1 is a diagram illustrating the overall configuration of an image forming apparatus 1 according to an exemplary embodiment of the invention. Hereinafter, a space in which components are disposed is represented as an xyz righthanded coordinate space in the accompanying drawings. A symbol in which two line segments intersect with each other are drawn in a white circle represents an arrow from the front side of a paper surface to the rear side thereof, among coordinate symbols illustrated in the accompanying drawings. A direction along an x axis in the space is referred to as an x-axis direction. A direction of the x-axis direction, in which a value of an x component is increased is referred to as a +x direction. A direction of the x-axis direction, in which the value of the x component is decreased, is referred to as a −x direction. Regarding a y component and a z component, a y-axis direction, a +y direction, a −y direction, a z-axis direction, a +z direction, and a −z direction are defined in accordance with the above definitions.

As illustrated in FIG. 1, the image forming apparatus 1 includes a control section 11, developing units 13Y, 13M, 13C, and 13K, a transfer unit 14, a fixing unit 15, and a transporting unit 16. Signs of Y, M, C, and K mean configurations corresponding to toners of yellow, magenta, cyan, and black, respectively. The developing units 13Y, 13M, 13C, and 13K do not have a particular difference in configuration from each other except that toners to be used are different. When it is not particularly necessary that the developing units 13Y, 13M, 13C, and 13K are distinguished from each other, an alphabetical character at the end of the signs, which indicates the color of the toner is omitted and the developing units 13Y, 13M, 13C, and 13K are described as "developing units 13" below.

The control section 11 includes a central processing unit (CPU), a read only memory (ROM), a random access memory (RAM), and a storage unit such as a solid state drive, and a hard disk drive. The CPU reads a computer program stored in the storage unit and executes the read computer program, and thereby the units of the image forming apparatus 1 are controlled.

The transporting unit 16 includes a container and transport rollers. Paper P which is cut so as to have a predetermined size is accommodated as a medium in the container. Each piece of the paper P accommodated in the container is retrieved by the transport rollers in accordance with an instruction from the control section 11. The retrieved piece of the paper P is transported to the transfer unit 14 through a paper transporting path. The medium is not limited to paper. For example, a resin sheet and the like may be used as the medium. In other words, any medium may be used as the medium as long as an image may be recorded on a surface thereof.

Figure 2:
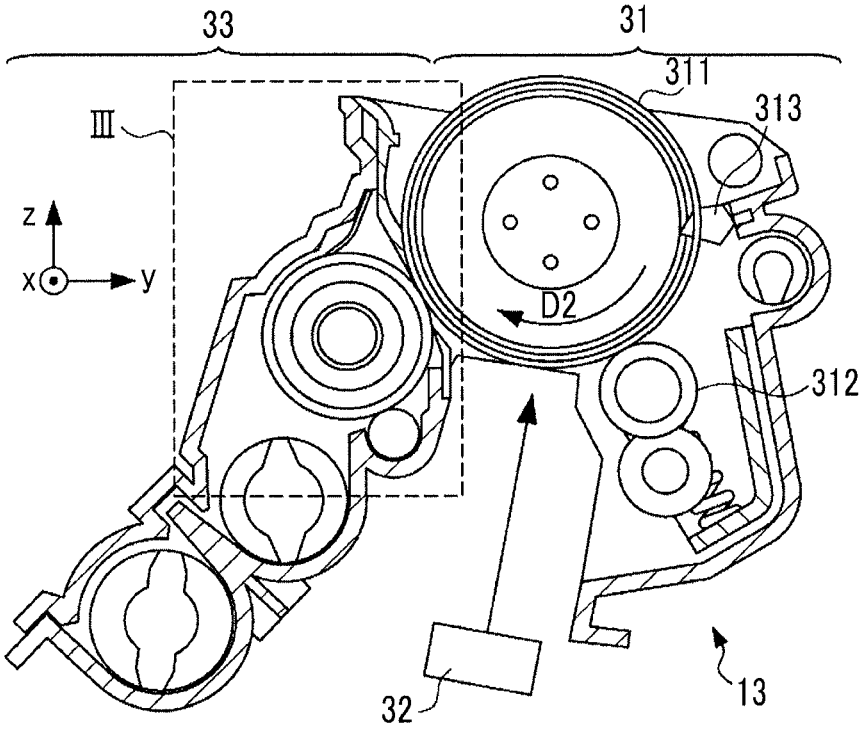
FIG. 2 is a diagram illustrating a configuration of a developing unit.

Each of the developing units 13 includes an image holding device 31, an exposure device 32, a developing device 33, and a primary transfer roller 35. FIG. 2 is a diagram illustrating a configuration of each of the developing units 13. In FIG. 2, illustration of the primary transfer roller 35 is omitted.

The image holding device 31 includes an image holding body 311, a charging device 312, and a cleaner 313. The image holding body 311 is a photosensitive drum which has a charge generation layer and a charge transport layer. The image holding body 311 is rotated in a direction indicated by an arrow D2 illustrated in FIG. 2, by a driving unit (not illustrated). The charging device 312 charges an outer circumferential surface of the image holding body 311.

The exposure device 32 includes plural light-emitting diodes (LED) and the like. The exposure device 32 irradiates the image holding body 311 charged by the charging device 312 with light in accordance with image data, under the control of the control section 11. Thus, a latent image is held on the outer circumferential surface of the image holding body 311.

The image data may be obtained from an external device through a communication unit (not illustrated) by the control section 11. An example of the external device includes a reading device that reads an original image, a storage device that stores data indicating an image, and the like. The exposure device 32 may be a raster output scanning type using a laser emitting source, a polygon mirror, or the like.

The developing device 33 supplies a developer to the outer circumferential surface of the image holding body 311. Thus, an image is formed (developed) on the outer circumferential surface of the image holding body 311.

The primary transfer roller 35 illustrated in FIG. 1 generates a predetermined potential difference at a position at which an intermediate transfer belt 41 of the transfer unit 14 faces the image holding body 311. The generated potential difference causes an image to be transferred onto the intermediate transfer belt 41. The cleaner 313 removes the toner which has not been transferred and remains on the outer circumferential surface of the image holding body 311 after a transfer of the image. The cleaner 313 eliminates charges on the outer circumferential surface of the image holding body 311.

The transfer unit 14 is a transfer unit that includes the intermediate transfer belt 41, a secondary transfer roller 42, a belt transport roller 43, a backup roller 44, and a belt cleaner 49, and transfers an image formed by the developing unit 13 to the paper P. The intermediate transfer belt 41 is an endless belt member. The belt transport roller 43 and the backup roller 44 stretch the intermediate transfer belt 41. At least one of the belt transport roller 43 and the backup roller 44 includes a driving unit (not illustrated), and rotates the intermediate transfer belt 41 in a direction indicated by an arrow D14 in FIG. 1.

The belt transport roller 43 or the backup roller 44 which does not have a driving unit is rotated along with the moving of the intermediate transfer belt 41. An image on the intermediate transfer belt 41 is moved into a region interposed between the secondary transfer roller 42 and the backup roller 44, by rotating the intermediate transfer belt 41 in the direction indicated by an arrow D14 in FIG. 1.

The secondary transfer roller 42 causes the image on the intermediate transfer belt 41 to be transferred to the paper P transported from the transporting unit 16, by using the potential difference between the secondary transfer roller 42 and the intermediate transfer belt 41. The belt cleaner 49 removes the toner which has not been transferred and remains on the surface of the intermediate transfer belt 41. The transfer unit 14 or the transporting unit 16 transports the paper P onto which an image is transferred, to the fixing unit 15. The fixing unit 15 fixes an image transferred onto the paper P, by heating.

1-2. Configuration of Developing Device

Figure 3:
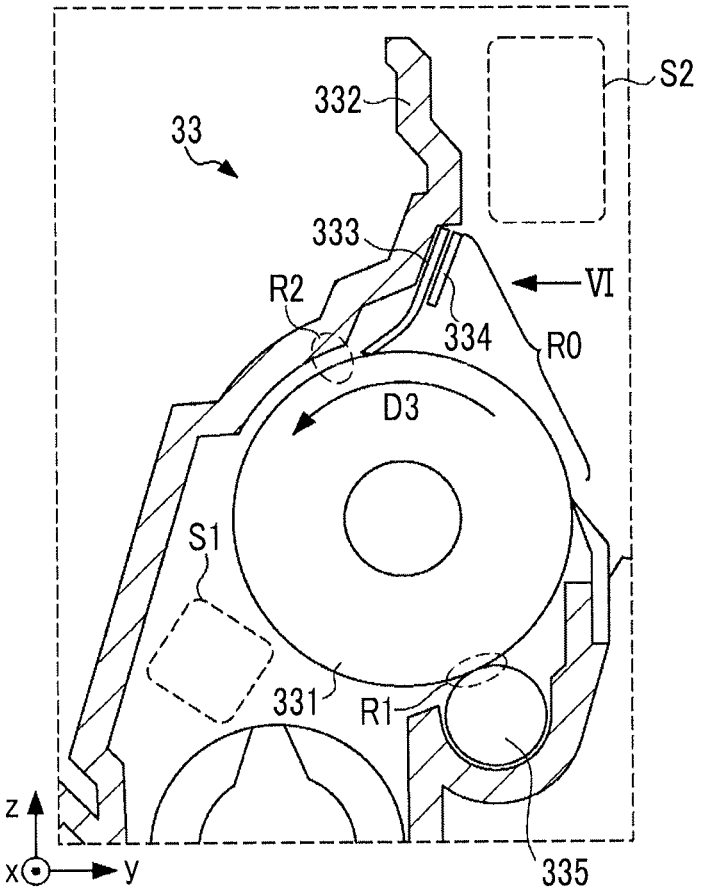
FIG. 3 is a diagram illustrating a configuration of a developing device.

FIG. 3 is an expanded diagram of a range III illustrated in FIG. 2, and is a diagram illustrating a configuration of the developing device 33. For example, the developer holding body 331 is a cylindrical member which is rotated by a driving device (not illustrated) around a magnetic core. The magnetic core generates a magnetic pattern determined by multiple magnets sticking to a surface thereof. While the developer holding body 331 holds the developer and is rotated in a direction indicated by D3 illustrated in FIG. 3, the developer holding body 331 supplies the developer to the image holding body 311 on which an electrostatic latent image is formed. The developer is a two-component developer which includes a toner of any one of the above-described colors, and a magnetic carrier such as ferrite powder. The magnetic carrier included in the developer is oriented in a diameter direction by magnetism generated from the magnetic core, and thereby the developer holding body 331 forms a magnetic brush on a surface thereof, and holds and transports the developer.

The container 332 accommodates the developer holding body 331. An opening portion R0 is provided to face the image holding body 311.

The contact member 333 is a film-like member fixed by bonding to an end portion of the opening portion R0 on a downstream side of the developer holding body 331 in the rotation direction. The contact member 333 extends in an axis direction of the developer holding body 331, and covers a region in which the developer holding body 331 may hold the developer. The contact member 333 is formed to have a length to such an extent that a tip end extending toward an inner side of the container 332 contacts with the developer holding body 331. As described above, since the contact member 333 is fixed to the end portion of the opening portion R0 on the downstream side of the developer holding body 331 in the rotation direction, the downstream side of the developer holding body 331 in the rotation direction is the inner side of the container 332, and an upstream side of the developer holding body 331 in the rotation direction is an outer side of the container 332 when viewed from the contact member 333.

Since the developing device 33 needs to be replaced when the developer held therein is consumed, the developing device 33 is formed so as to be attachable to and detachable from the image forming apparatus 1. For example, the developing device 33 is inserted and removed in the axis direction of the developer holding body 331, and a single developing device may be also distributed as a product. The developing device 33 is, for example, transported in the process of distribution. Thus, the developing device 33 may receive an impact from the outside. Also, the developer may be moved from an internal space S1 of the developing device 33 toward a space S2 in which the image holding body 311 (not illustrated in FIG. 3) is disposed, depending on a degree of the received impact and/or a direction of the received impact.

Gaps between the container 332 and the developer holding body 331 are two gaps R1 and R2 illustrated in FIG. 3 container. That is, when the developer is moved from the internal space S1 to the space S2, the developer is required to pass through either of the gap R1 or the gap R2. The gap R1 is a gap on the upstream side of the developer holding body 331 in the rotation direction, prior to the opening portion R0. A layer regulation member 335 adjusts the height (thickness) of the magnetic brush (developer) which is held on the surface of the developer holding body 331, in the gap R1. The gap R2 is a gap on a downstream side of the developer holding body 331 in the rotation direction, lower than the opening portion R0. The gap R2 is a gap for causing the remaining developer (that is, developer which is held by the developer holding body 331 and is not supplied to the image holding body) to return to the inside of the container 332. If the gap is narrowed, clogging with the developer may occur. If a load by the rotating developer holding body 331 is applied to the gap R2 in a state where the gap R2 is clogged up with the developer, the developer holding body 331 may have problems. Accordingly, the gap R2 is formed so as to be wider than the gap R1. Thus, the developer in the internal space S1 is moved to the space S2 more easily through the gap R2 than the gap R1.

However, the above-described contact member 333 is fixed to the end portion of the opening portion R0 on the downstream side of the developer holding body 331 in the rotation direction, and the tip end extends toward the inner side of the container 332 so as to contact with the developer holding body 331. Therefore, even when an impact from the outside is to cause the developer to move from the internal space S1 to the space S2 through the gap R2, the developer may be blocked by the contact member 333.

If the gap R2 is formed wide without any blocking object, air flow passing through the gap R2 is generated when a pressure difference between the internal space S1 and the space S2 occurs in a state where the developing device 33 is mounted in the image forming apparatus 1. The developer may flow through the air flow from the inside of the container 332 onto the image holding body 311 container, and a latent image held by the image holding body 311 may be in disorder. Thus, as described above, the contact member 333 which has a tip end contacting with the developer holding body 331 is provided so as to block the gap R2. The contact member 333 functions as a partition which causes generation of the air flow passing through the gap R2 to be difficult when the above-described pressure difference is generated. When such pressure difference does not occur, the contact member 333 is a film-like member having flexibility. Thus, the contact member 333 is deformed in accordance with the quantity of the developer held by the developer holding body 331 and the return of the developer into the container 332 is not prevented.

The restriction member 334 is a film-like member disposed on the image holding body 311 side so as to be closer to the image holding body 311 than the contact member 333 side. The restriction member 334 is a member extending in the axis direction of the developer holding body 331 along with the contact member 333. The restriction member 334 restricts a posture of the contact member 333. The restriction member 334 is bonded to an opposite side of the contact member 333 to a surface of the contact member 333 to which the end portion of the opening portion R0 is bonded.

Figure 4A:
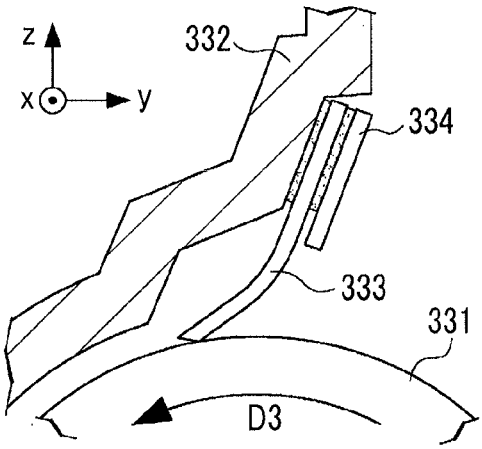
FIGS. 4A to 4D are diagrams illustrating a function of a contact member.
Figure 4B:
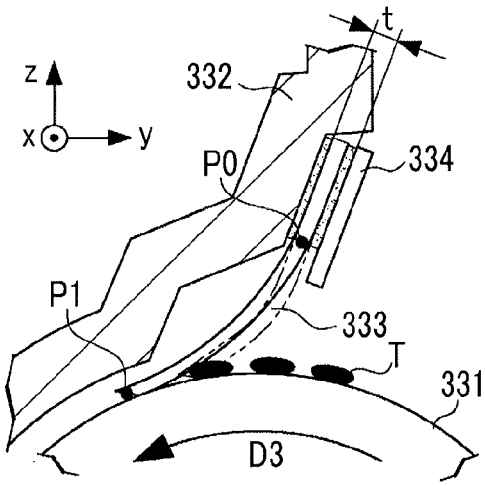
Figure 4C:
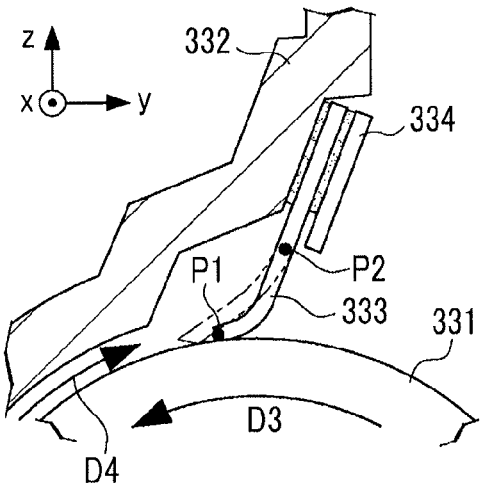
Figure 4D:
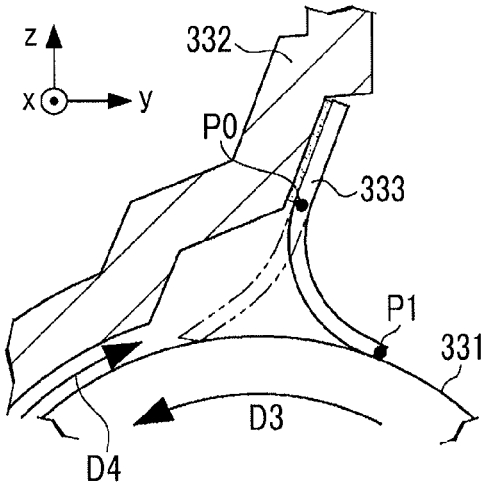

FIGS. 4A to 4D are diagrams illustrating the function of the contact member 333. As illustrated in FIG. 4D, if the restriction member 334 is not provided, the contact member 333 has a free length from a fixation point P0 at which the contact member 333 is fixed to the container 332 to the tip end P1 of the contact member 333. The fixation point P0 is a portion nearest to the developer holding body 331 among portions of the contact member 333, which are fixed to the container 332. Thus, if, for example, the developer flows in a direction indicated by an arrow D4 (direction in which the gap R2 illustrated in FIG. 3 is directed toward the image holding body 311) due to an impact from the outside, the contact member 333 may have such a posture that the tip end P1 is located further outside of the container 332 than the fixation point P0 is (that is, located on the upstream side of the developer holding body 331 in the rotation direction in this example), as illustrated in FIG. 4D. That is, for example, if an impact is received from the outside in the process of distribution, a flow of the developer in a direction from the container 332 toward the image holding body 311 may occur, and the contact member 333 may curl and have such a posture that the tip end P1 is directed toward an outside of the container 332. If the contact member 333 has this posture, it is difficult for the contact member 333 to deform in accordance with the quantity of the developer held by the developer holding body 331. Accordingly, it is difficult that the developer returns to the container 332, and the developer is easily accumulated at the opening portion R0 of the container 332.

The developer holding body 331 is continuously rotated. Thus, even if the contact member 333 has such a posture that the tip end thereof is directed toward the outside of the container 332, the contact member 333 may go back to the original posture by the rotational motion of the developer holding body 331 container, that is, the posture of the contact member 333 may return to such a posture that the tip end thereof is directed toward the inside of the container 332.

If the restriction member 334 is disposed on the image holding body 311 side image holding body of the contact member 333 as illustrated in FIG. 4A, the restriction member 334 does not prevent the contact member 333 from being deformed in the direction indicated by the arrow D3. Accordingly, as illustrated in FIG. 4B, even when developers T which have not been supplied remain on the surface of the developer holding body 331 rotating in the direction indicated by the arrow D3, the contact member 333 pressed by the developers T is deformed along the rotation direction and is deformed so as to have such a posture that the contact member 333 is separated from the restriction member 334 by a distance t. Thus, the developers T are caused to return to the inside of the developing device 33.

Even when the flow of the developer in a direction indicated by the arrow D4 occurs, as illustrated in FIG. 40, a tip end of the restriction member 334 restrains a restraint point P2 of the contact member 333. Therefore, the free length of the contact member 333 ranges from the restraint point P2 to the tip end P1. A length at a time when the contact member 333 is deformed by the rigidity of the contact member 333 and an external force may be smaller than the above-described free length. However, the length is longer than a gap between the tip end of the restriction member 334 and the developer holding body 331. As a result, a portion of the contact member 333 from the restraint point P2 to the tip end P1 is not enabled to go across a gap between the tip end of the restriction member 334 and the developer holding body 331, and the contact member 333 is not deformed so as to be in a state where the tip end P1 is directed toward the outside of the container 332. That is, the tip end P1 is not positioned on an upstream side of the restraint point P2. In other words, the contact member 333 does not flip even when the flow of the developer in a direction indicated by the arrow D4 is generated.

2. Modification Example

Hitherto, the exemplary embodiment is described. However, details of the exemplary embodiment may be modified as follows. The following modification examples may be combined.

2-1. Modification Example 1

In the above-described exemplary embodiment, both the contact member 333 and the restriction member 334 are film-like members, and the restriction member 334 is provided so as to overlap the contact member 333. However, the restriction member 334 may or may not be a film-like shape.

Figure 5:
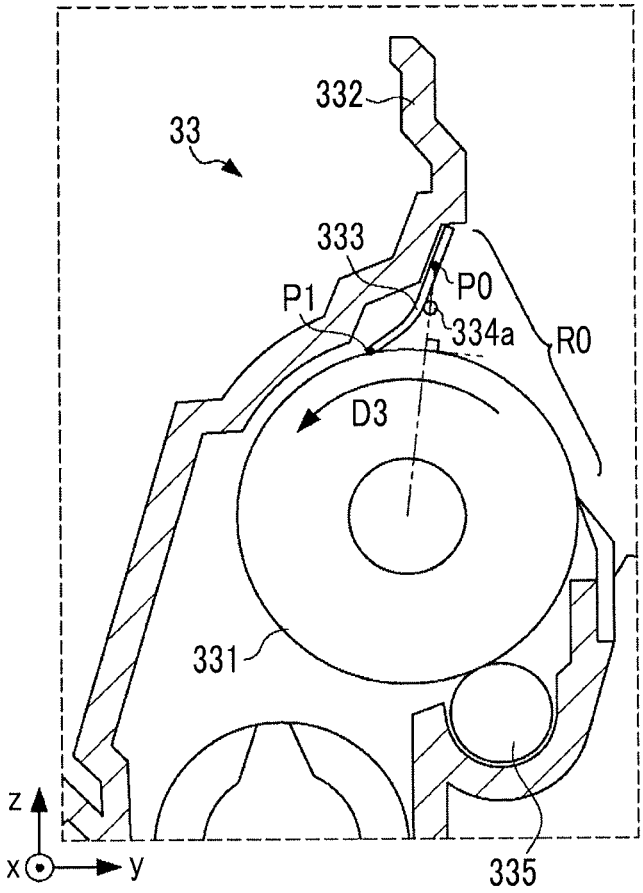
FIG. 5 is a diagram illustrating an example of a restriction member in a modification example.

FIG. 5 is a diagram illustrating an example of the restriction member in the modification example. In the modification example, the developing device 33 includes a restriction member 334*a*. The restriction member 334*a* is a bar-like member which extends in the axis direction of the developer holding body 331. The restriction member 334*a* is disposed between the fixation point P0 at which the contact member 333 is fixed to the end portion of the opening portion R0, and the developer holding body 331. For example, the restriction member 334*a* is disposed on a line which links the above fixation point P0 and a rotation shaft of the developer holding body 331 to each other.

With this configuration, the restriction member 334*a* is brought into contact with the contact member 333 at any position in a range from the fixation point P0 to the tip end P1, and restricts the posture such that the contact member 333 is not moved in the +y direction. With this configuration, the contact member 333 does not flip even when the flow of the developer is generated.

As in the above-described exemplary embodiment, both the contact member 333 and the restriction member 334 are film-like members and are provided so as to overlap each other. Thus, manufacturing is easily performed in comparison to a case of using a member other than the film-like member.

2-2. Modification Example 2

In the above-described exemplary embodiment, materials of the contact member 333 and the restriction member 334 are not particularly limited. However, the restriction member 334 is desirably formed of a material which has rigidity higher than that of the contact member 333. Use of the material having rigidity higher than that of the contact member 333 causes deformation of the restriction member 334 by a force received from the contact member 333 to be performed more difficultly than that in a case of using other materials.

2-3. Modification Example 3

A region in which the restriction member 334 is bonded to the contact member 333 may be changed in accordance with the axis direction (x-axis direction) of the developer holding body 331.

Figure 6:
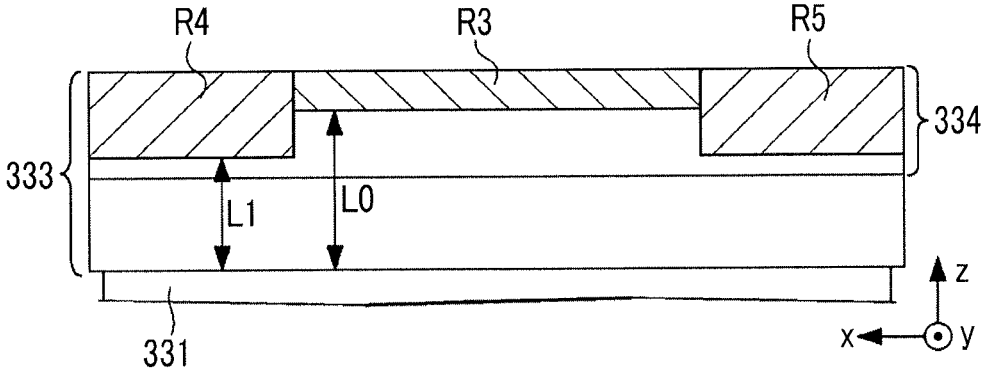
FIG. 6 is a diagram illustrating a bonding region of the contact member and the restriction member.

FIG. 6 is a diagram illustrating a bonding region of the contact member 333 and the restriction member 334. FIG. 6 illustrates a form obtained by viewing the contact member 333, the restriction member 334, and the developer holding body 331 from a direction indicated by an arrow VI illustrated in FIG. 3. In FIG. 6, a portion at which the contact member 333 is fixed to the container 332 is on a +z direction of the contact member 333. As illustrated in FIG. 6, a region R4 and a region R5 which are bonded to the contact member 333 at both ends of the restriction member 334 in the axis direction (x-axis direction) of the developer holding body 331 are longer in the z-axis direction than a region R3 bonded to the contact member 333 at the center in this axis direction. Thus, a distance L1 between the region R4 or the region R5, and the developer holding body 331 is smaller than a distance L0 between the region R3 and the developer holding body 331.

If a portion of the contact member 333, which is not bonded to the restriction member 334, is to move toward the image holding body 311, the posture of the portion of the contact member 333 is restricted by the restriction member 334. However, when the portion of the contact member 333 is to move toward an opposite side to the image holding body 311 (that is, inner side of the container 332), the portion of the contact member 333 is separated from the restriction member 334. Thus, the posture of the contact member 333 is not restricted. On the other hand, a portion of the contact member 333, which is bonded to the restriction member 334, is not separated from the restriction member 334 even if such a portion of the contact member 333 is to move toward the opposite side to the image holding body 311. Thus, the posture of the contact member 333 is restricted.

Accordingly, as a distance between the developer holding body 331 and the region of the contact member 333 in which the contact member 333 is bonded to the restriction member 334 is shorter, the posture of the contact member 333 is further restricted by the restriction member 334, and it is more difficult for an external force to deform the contact member 333. Generation of the flow of the developer which passes through the gap R2 illustrated in FIG. 3 in a direction toward the image holding body 311 is difficult.

The developer holding body 331 has a region (non-image region) in which a latent image is not formed at a position of the image holding body 311 corresponding to the developer holding body 331, at both of the ends thereof in the axis direction. That is, since a supply of the developer to the non-image region of the image holding body 311 is not required, the developer may not be held at both of the ends of the developer holding body 331, and the developer holding body 331 may abut on the contact member 333 more strongly than the center portion which holds the developer. Accordingly, the contact member 333 may be formed so as to cause the free length at both ends of the contact member 333 in the axis direction to be reduced. That is, the restriction member 334 may be formed such that the distance between the developer holding body 331 and the region of the restriction member 334 at both of thereof in the axis direction where the restriction member 334 is bonded to the contact member 333 is smaller than that at the center thereof in the axis direction.

2-4. Modification Example 4

In the above-described exemplary embodiment, the contact member 333 is fixed by bonding of the developer holding body 331 to the end portion of the opening portion R0 on the downstream side of the developer holding body 331 in the rotation direction. However, a method for fixing is not limited to bonding. For example, fixing may be performed through welding, or by using a joining member such as a pin and a screw. The contact member 333 may not be fixed to the end portion of the opening portion R0 as long as the contact member 333 is fixed to the container 332 on the downstream side of the developer holding body 331 in the rotation direction by using the opening portion R0 as a reference. The contact member 333 may be molded so as to be integrated with the container 332 as long as the contact member 333 is fixed to the container 332.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a cylindrical developer holding body that supplies a developer to an image holding body on which an electrostatic latent image is formed, while holding the developer and rotating;

a container that accommodates the developer holding body and that is formed with an opening portion facing the image holding body;

a deformable contact member that is fixed in the container and on a downstream side of the opening portion body in a rotation direction of the developer holding body and that includes a tip end which extends toward an inner side of the container and which contacts with the developer holding body; and a restriction member that is disposed on an image holding body side of the deformable contact member and that restricts the tip end of the deformable contact member from deforming so as to be in a state where the deformable contact member is directed toward an outer side of the container, wherein the restriction member extends in an axis direction of the developer holding body and is bonded to an opposite side of the deformable contact member to a surface of the deformable contact member which is fixed to the container, and a distance between the developer holding body and a region of the restriction member which is bonded to the deformable contact member at both ends of the restriction member in the axis direction is smaller than a distance between the developer holding body and a region of the restriction member which is bonded to the deformable contact member at a center of the restriction member in the axis direction.

2. The developing device according to claim 1, wherein the restriction member is provided between the developer holding body and a portion nearest to the developer holding body among portions of the deformable contact member which are fixed to the container, and when the tip end is to be deformed so as to be in the state where the tip end is directed from the inner side of the container toward the outer side of the container, the restriction member is brought into contact with the deformable contact member.

3. The developing device according to claim 1, wherein each of the deformable contact member and the restriction member is a film-shaped member, and the restriction member is provided so as to overlap the deformable contact member.

4. The developing device according to claim 2, wherein each of the deformable contact member and the restriction member is a film-shaped member, and the restriction member is provided so as to overlap the deformable contact member.

5. The developing device according to claim 3, wherein the restriction member has a rigidity higher than a rigidity of the deformable contact member.

6. The developing device according to claim 4, wherein the restriction member has a rigidity higher than a rigidity of the deformable contact member.

7. The developing device according to claim 1, wherein the restriction member contacts with a portion between a point on the deformable contact member where the deformable contact member is fixed to the container and the tip end, to restrict a posture of the deformable contact member.

8. The developing device according to claim 2, wherein the restriction member contacts with a portion between a point on the deformable contact member where the deformable contact member is fixed to the container and the tip end, to restrict a posture of the deformable contact member.

9. The developing device according to claim 3, wherein the restriction member contacts with a portion between a point on the deformable contact member where the deformable contact member is fixed to the container and the tip end, to restrict a posture of the deformable contact member.

10. The developing device according to claim 4, wherein the restriction member contacts with a portion between a point on the deformable contact member where the deformable contact member is fixed to the container and the tip end, to restrict a posture of the deformable contact member.

11. The developing device according to claim 5, wherein the restriction member contacts with a portion between a point on the deformable contact member where the deformable contact member is fixed to the container and the tip end, to restrict a posture of the deformable contact member.

12. The developing device according to claim 6, wherein the restriction member contacts with a portion between a point on the deformable contact member where the deformable contact member is fixed to the container and the tip end, to restrict a posture of the deformable contact member.

13. An image forming apparatus comprising:

the developing device according to claim 1;

an image holding body that holds an electrostatic latent image and receives a developer supplied from the developing device; and a transfer section that transfers an image, which is developed with the developer supplied from the developing device, from the image holding body to a medium.

* * * * *